United States Patent [19]

Torihata et al.

[11] Patent Number: 4,986,898

[45] Date of Patent: Jan. 22, 1991

[54] METHOD OF REMOVING MERCURY FROM HYDROCARBON OILS

[75] Inventors: Takashi Torihata; Satoyuki Nisimura, both of Chiba, Japan

[73] Assignee: Mitsui Petrochemical Industries, Ltd., Tokyo, Japan

[21] Appl. No.: 351,593

[22] Filed: May 15, 1989

[30] Foreign Application Priority Data

May 16, 1988 [JP] Japan ..... 63-118835
Jun. 14, 1988 [JP] Japan ..... 63-146325

[51] Int. Cl.[5] ..... C10G 17/00

[52] U.S. Cl. ..... 208/251 R; 208/299; 208/302; 208/307; 208/296; 208/297; 208/295; 585/820

[58] Field of Search ..... 208/299, 302, 307, 251 R

[56] References Cited

U.S. PATENT DOCUMENTS

| | | | |
|---|---|---|---|
| 3,704,875 | 12/1972 | Waltrich | 210/50 |
| 3,876,393 | 4/1975 | Kasei et al. | 55/68 |
| 3,919,077 | 11/1975 | Whitehurst | 208/251 R |
| 4,116,820 | 9/1978 | Blytas | 208/251 R |
| 4,227,995 | 10/1980 | Sze et al. | 208/251 H |
| 4,448,896 | 5/1984 | Kageyama et al. | 208/251 H |
| 4,709,118 | 11/1987 | Yan | 585/820 |

*Primary Examiner*—Helane E. Myers

*Attorney, Agent, or Firm*—Birch, Stewart, Kolasch & Birch

[57] ABSTRACT

Trace amounts of mercury and its compounds present in hydrocarbon oil can be removed selectively and efficiently by bringing the hydrocarbon oils containing mercury and its compounds into contact with a certain treating agent after having heated such oils. Since the hydrocarbon oil from which mercury and its compounds have been removed does not contain catalyst poisons, such a hydrocarbon oil can be used extensively for catalytic reaction processes such as hydrogenation.

3 Claims, 1 Drawing Sheet

METHOD OF REMOVING MERCURY FROM HYDROCARBON OILS

BACKGROUND OF THE INVENTION

The present invention relates to a method of removing mercury as a simple substance and/or mercury compounds (hereinafter often referred to as "mercury and its compounds") which is or are present in hydrocarbon oils.

For reforming hydrocarbon oils such as naphtha by, for example, hydrogenation, such catalysts as palladium catalyst supported on alumina are used. On the other hand, if mercury and its compounds are present in hydrocarbon oils as impurities, such reaction as hydrogenation cannot be carried out sufficiently due to the catalyst poisoning caused by such impurities.

Therefore, the following methods have been conventionally practiced for the removal of mercury and its compounds:

(a) Physical adsorption methods for which porous adsorbents such as activated carbon, molecular sieve, silica gel, zeolite, and alumina are employed.

(b) Methods of removing mercury and its compounds by reaction between mercury and sulfur or adsorption by means of using metal sulfides or adding sulfur to a porous adsorbent.

However, the physical adsorption method mentioned in (a) above gives a low mercury removal ratio of 30 to 70 weight percent, whereas heavy fractions and gummy matter are removed efficiently from hydrocarbon oil. The reactive adsorption method mentioned in (b) above gives a low mercury removal ratio as is the case with the physical adsorption method (a), while filtration after the reactive adsorption step is made with great difficulty.

For the aforesaid reason, a strong need exists for developing a method that is capable of selectively and efficiently removing mercury from hydrocarbon oils.

SUMMARY OF THE INVENTION

The object of the present invention is to provide a method by which mercury and its compounds present in trace amounts in hydrocarbon oil can be removed selectively and efficiently, over an extensive period of time.

The present invention provides a method of removing mercury and its compounds present in trace amounts in hydrocarbon oil by first heating the hydrocarbon oil containing the mercury and its compounds and then bringing such hydrocarbon oil into contact with the following treating agent.

The treating agent herein referred to is the one which is in a granular or powdery form and is at least one type of metal selected from among iron, nickel, copper, zinc, aluminum and cadmium, its alloy and/or oxide, chloride, sulfide or their mixture, or either constituent being supported on the surface layer of another constituent.

The treating agent is also activated carbon itself or activated carbon upon whose surface layer is supported at least one type of metal selected from among iron, nickel, copper, zinc, tin, aluminum and cadmium, its alloy and/or oxide, chloride, sulfide or their mixture.

DETAILED DESCRIPTION OF THE INVENTION

Figure 1:
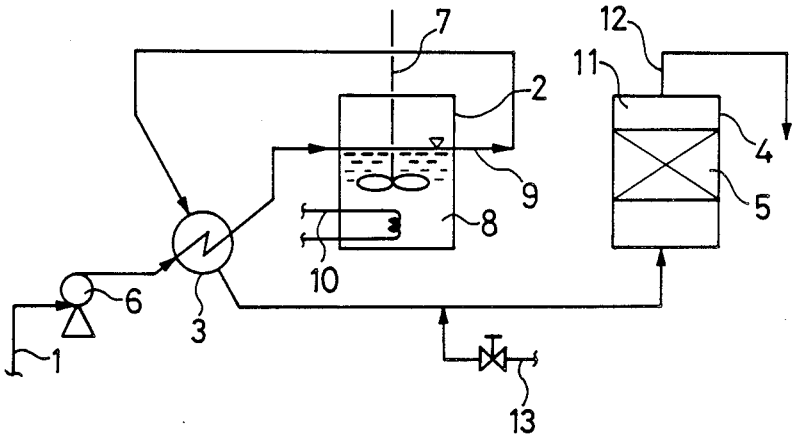
FIG. 1 and FIG. 2 are diagrams showing examples of the apparatus for practicing the method of the present invention.

The method of the present invention is described hereinafter in detail.

The method of the present invention is applicable to all hydrocarbon oils that are liquid at ordinary temperature.

Illustrative hydrocarbon oils include crude oils, straight run naphtha, kerosene, gas oil, vacuum distillates, atmospheric residues, thermal cracked gasoline obtained as a by-product in the thermal cracking unit of an ethylene plant, naphtha fractions produced in a catalytic cracking unit, and recycled oils.

The method of the present invention is particularly suitable for the removal of mercury and its compounds from natural gas liquid (NGL) obtained by stripping natural gas of liquefied petroleum gas (LPG), especially from heavy natural gas liquid which contains high-boiling point components.

Mercury and its compounds to be removed from hydrocarbon oil by the method of the present invention may be present in any form such as metallic, inorganic or organic, or as a mixture of the same.

The concentration of mercury and its compounds in hydrocarbon oil is not limited to any particular value, but from the viewpoint of reaction efficiency, the concentration of mercury and its compounds is 400–600 ppb, more preferably 100–150 ppb.

If necessary, sludge and other solids in hydrocarbon oil may be removed by passing the oil through a filtration membrane or some other filtration medium so that such mercury and its compound as can be filtered out together with the sludge may be removed beforehand.

The process of the present invention comprises a heating of the hydrocarbon oil.

The temperature of the reaction vessel is typically 50–400 ° C., preferably 150–300 ° C. The pressure is maintained at 0.5–35 $Kgf/cm^2G$, preferably 2.0–35 $Kgf/cm^2G$.

The space velocity (SV) in the reaction vessel is maintained at 0.2–100 $hr.^{-1}$, preferably 2–60 $hr.^{-1}$.

The reaction vessel used in the present invention may be of the agitating type, the tubular type or the fixed bed type. However, the ratio of removal of mercury and its compounds is furthermore improved by means of packing the reaction vessel with the treating agent employed for the catalytic reaction, preferably a carrier-supported treating agent.

Next, the hydrocarbon oil is reacted with the treating agent by bringing the oil into contact therewith.

The treating agent to be packed in the reaction vessel is the one which is in a granular or powdery form and at least one type of metal selected from among iron, nickel, copper, zinc, aluminum and cadmium, and may be used by itself or as a combination of two types or more of these metals.

It may be a metal oxide such as alumina, etc., a metal chloride, and a metal sulfide or a mixture thereof, or the one consisting of either constituent being supported on the surface of another.

Double oxides or complex oxides may be used as oxides.

For the alumina carrier to support the treating agent, good results are attained with the one having a specific surface area of typically 150–600 $m^2/g$ as measured by the BET method, preferably 200–400 $m^2/g$.

The pore size of the carrier is typically in the range from 0.2 to 0.9 cc/g as the value measured by the BET method, preferably in the range from 0.5 to 0.8 cc/g.

An example of the treating agent supported on alumina carrier is cited as follows:

(1) Supporting of iron: The carrier, which is alumina, is added to and immersed for about 15 hours in an aqueous solution of ferric nitrate $[Fe(NO_3)_3 6H_2O]$and then the catalyst is retrieved.

After the retrieved catalyst has been dried, it is sintered in the presence of air at 250 ° C. for about 5 hours.

(2) Supporting of copper: The carrier, which is alumina, is added to and immersed for about 15 hours in an aqueous solution of copper $[Cu(NO_3)_2 3H_2O]$and then the catalyst is retrieved.

After the retrieved catalyst has been dried, it is sintered in the presence of air at 250 ° C. for about 5 hours.

(3) Supporting of nickel: The carrier, which is alumina, is added to and immersed for about 15 hours in an aqueous solution of nickel nitrate $[Ni(NO_3)_2 6H_2O]$and then the catalyst is retrieved.

After the retrieved catalyst has been dried, it is sintered in the presence of air at 550 ° C. for about 5 hours.

The other treating agent packed in the reaction vessel may be activated carbon itself, but it may be at least one type of metal selected from among iron, nickel, copper, zinc, tin, aluminum and cadmium, a combination of two or three types of these metals, or a metal oxide such as alumina, metal chloride, metal sulfide or its mixture supported on activated carbon may be used.

Double oxides or complex oxides may be used as oxides.

In case activated carbon is used as the carrier, good results are attained with an activated carbon having a specific surface area of typically 100–1500 $m^2/g$ as measured by the BET method, preferably 800–1300 $m^2/g$, and a pore size of, 0.5–1.2 cc/g as measured by the BET method, preferably 0.8–1.0 cc/g.

An example of the treating agent supported on activated carbon carrier is cited as follows:

(1) Copper chloride: Cupric chloride is dissolved in water, an inorganic solvent such as hydrochloric acid solution, or an organic solvent such as acetone and alcohol. Next, activated carbon is immersed in such solutions. Then, after removing the solvent from the activated carbon with an evaporator, the activated carbon is dried and sintered to prepare an activated carbon with copper supported on it.

(2) Tin chloride: Stannous chloride is dissolved in water, an inorganic solvent such as hydrochloric acid solution, or an organic solvent such as acetone and alcohol. Next, activated carbon is immersed in such solutions. Then, after removing the solvent from the activated carbon with an evaporator, the activated carbon is dried and sintered to prepare an activated carbon with tin supported on it.

The temperature of the reaction vessel is typically 20–250 ° C., preferably 20–150 ° C.

The space velocity (SV) in the reaction vessel is maintained at 0.5–10 $hr.^{-1}$, preferably 1.0–5.0 $hr.^{-1}$. Mercury and its compounds are captured efficiently and the removal ratio is improved under these conditions. The service cycle of the treating agent up to its regeneration is also extended.

Various solid-liquid catalytic processes are employable for the catalytic reaction between the said treating agent and hydrocarbon oil in the method of the present invention. For example, either one of a fixed bed type, a moving bed type, or a fluidized bed type may be used.

The following reaction apparatus is preferably used. However, the present invention is not limited thereto.

FIG. 1 shows an apparatus equipped with a reaction vessel (2) provided with a heat source (10) and an agitator (7) and a reaction vessel (4) in which the treating agent is employed as a fixed bed (5).

Hydrocarbon oil, which is feed stock oil (1), is transferred through the tube side of a heat exchanger (3) via a pump (6) into the reaction vessel (2), in which it is heated as heated oil (8). The heated oil is transferred through a discharge outlet (9) into the heat exchanger (3), in which it is cooled down. The feed stock oil thus cooled down is transferred into the reaction vessel (4) through its bottom. In the reaction vessel, mercury and its compounds are removed as the feed stock oil contacts the fixed bed.

Purified liquid (11) is retrieved through a discharge line (12) installed in the top part of the reaction vessel (4). Nitrogen as the carrier gas may be supplied through a nitrogen feed line (13) installed between the heat exchanger (3) and the reaction vessel (4), if necessary.

Figure 2:
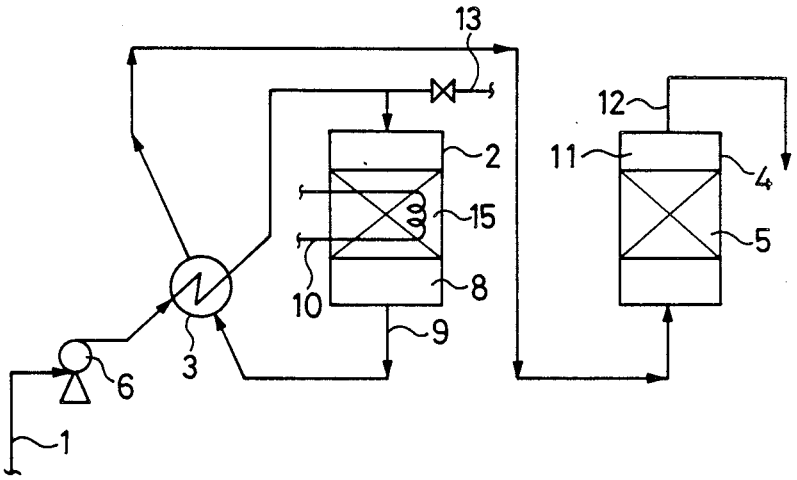

FIG. 2 shows an apparatus comprising a reaction vessel (2) provided with a heat source (10) and a fixed bed (15) including the treating agent supported on the carrier, and a reaction vessel (4) provided with a fixed bed (5) in which the treating agent is supported on the carrier.

Hydrocarbon oil, which is feed stock oil (1), is transferred through the tube side of a heat exchanger (3) via a pump (6) into the reaction vessel (2). The heated feed stock oil (8) accumulated in the vessel (2) is transferred through a discharge outlet (9) into the heat exchanger (3), in which it is cooled down. The feed stock oil thus cooled down is transferred into the reaction vessel (4) through its bottom. In the reaction vessel, mercury and its compounds are removed as the feed stock oil contacts the fixed bed, comprising the treating agent supported on alumina, etc.

Purified liquid (11) is retrieved through a discharge line (12) installed in the top part of the reaction vessel (4). Nitrogen as the carrier gas may be supplied through a nitrogen feed line (13) installed between the heat exchanger (3) and the reaction vessel (2), if necessary.

EXAMPLES

The following examples are provided for the purpose of further illustrating the present invention but are in no way to be taken as limiting.

EXAMPLE 1

Heavy natural gas liquid (H-NGL) was filtered through 0.2 micrometer Milipore (trademark) filter. The composition of the sludge thus filtered out was as follows:

Fe: 10.0 wt%
Si: 18.3 wt%
Hg: 3.1 wt%
S: 2.3 wt%

The mercury concentration of the filtrate was 150 ppb. The said liquid was passed at a rate of 100 milliliter per hour through a mercury removing apparatus equipped with a reaction vessel of a 100 milliliter capacity, a fixed bed of a 50 milliliter capacity, and a reaction vessel of a 200 milliliter capacity.

The mercury concentration and the mercury removal ratio measured after the lapse of twenty-four hours after the start of the liquid feed are shown in Table 1. As a Comparative Example, results for cases in which the same catalyst was used but no heating was made are shown in Table 1.

EXAMPLE 2

The same liquid as used in EXAMPLE 1 was used. 100 milliliter of the liquid and 1.0 gram of the catalyst shown in Table 2 were put into a reaction vessel. The liquid was heated with agitation in the reaction vessel at 200 ° C. for 30 minutes in Batchwise. The mercury concentration and the mercury removal ratio of the heated liquid are shown in Table 2.

As a Comparative Example, results for cases in which the same catalyst was used but no heating was made are shown in Table 2.

EXAMPLE 3

The same liquid as used in EXAMPLE 1 was treated in Batchwise. 400 milliliter of the liquid and alumina catalyst on which copper is supported was used. The mercury removal ratios for various heating times and heating temperatures are shown in Table 3.

The treating agent specified below was used.

(a) Carrier—$Al_2O_3$ Specific surface area 350 $m^2/g$; Pore size 0.80 cc/g (b) Treating agent—Using the above carrier, treating agents were prepared in the following manners:

$Fe_2O_3/Al_2O_3$: After immersing the carrier in a ferric nitrate solution, the carrier was dried and sintered at 250 ° C. for 5 hours. The supporting ratio is 1.6 g as Fe against 100 g of $Al_2O_3$.

$CuO/Al_2O_3$: After immersing the carrier in a copper nitrate solution, the carrier was dried and sintered at 250 ° C. for 5 hours. The supporting ratio is 2.6 g as Cu against 100 g of $Al_2O_3$.

$NiO/Al_2O_3$: After immersing the carrier in a nickel nitrate solution, the carrier was dried and sintered at 550 ° C. for 5 hours. The supporting ratio is 2.0 g as Ni against 100 g of $Al_2O_3$.

TABLE 1

| Treating agent | Without Heating (COMPARATIVE EXAMPLE) Hg concentration of liquid (ppb) | Removal ratio (%) | With Heating (EXAMPLE) Hg concentration of liquid (ppb) | Removal ratio (%) |
|---|---|---|---|---|
| $Fe_2O_3/Al_2O_3$ | 139 | 7.3 | 18 | 88.0 |
| $CuO/Al_2O_3$ | 127 | 15.3 | 8 | 94.7 |
| $NiO/Al_2O_3$ | 132 | 12.0 | 13 | 91.3 |

In this case, the mercury concentration in the feed stock oil is 150 ppb.

TABLE 2

| Treating agent | Without Heating (COMPARATIVE EXAMPLE) Hg concentration of liquid (ppb) | Removal ratio (%) | With Heating (EXAMPLE) Hg concentration of liquid (ppb) | Removal ratio (%) |
|---|---|---|---|---|
| Fe | 141 | 6.0 | 41 | 72.7 |
| $Fe_2O_3$ | 144 | 4.0 | 44 | 70.7 |
| $Fe_2S_3$ | 136 | 9.3 | 48 | 68.0 |
| Cu | 129 | 14.0 | 10 | 93.3 |
| CuO | 132 | 12.0 | 15 | 90.0 |
| CuS | 125 | 16.7 | 18 | 88.0 |

TABLE 2-continued

| Treating agent | Without Heating (COMPARATIVE EXAMPLE) Hg concentration of liquid (ppb) | Removal ratio (%) | With Heating (EXAMPLE) Hg concentration of liquid (ppb) | Removal ratio (%) |
|---|---|---|---|---|
| Ni | 133 | 11.3 | 20 | 86.7 |
| NiO | 130 | 13.3 | 24 | 84.0 |
| NiS | 120 | 20.0 | 25 | 83.3 |

In this case, the mercury concentration in the feed stock oil is 150 ppb.

TABLE 3

| Heating time (minutes) | Mercury Removal Ratio (%) Heating temperature (°C.) 150 | 200 | 250 |
|---|---|---|---|
| 15 | 88.7 | 94.4 | 93.0 |
| 30 | 91.5 | 97.2 | 95.8 |
| 45 | 91.5 | 98.6 | — |
| 60 | 93.0 | 98.6 | 98.6 |

EXAMPLE 4

The same liquid as used in EXAMPLE 1 was introduced into the same mercury removing apparatus as used in EXAMPLE 1 at the rate of 500 milliliters per hour. The mercury concentration and the mercury removal ratio measured 50 hours after the start of the introduction of the liquid are shown in Table 4.

As a Comparative Example, results obtained for cases in which the same catalyst was used but no heating was made are shown in Table 4.

The treating agent specified below was used.

(a) Activated carbon—CAL manufactured by Toyo Calgon Co. Specific surface area 1050 $m^2/g$: Pore size 0.94 cc/g (b) Treating agent—After immersing the said activated carbon in aqueous solutions of the following metallic salts, treating agents were prepared:

| Metallic salt | Manufacturer | Supporting ratio (Wt. % as pure metal vs. activated carbon) |
|---|---|---|
| $ZnCl_2$ | Wako Junyaku K.K. | 4.8 |
| $FeCl_3$ | Wako Junyaku K.K. | 2.1 |
| $NiCl_2$ | Wako Junyaku K.K. | 2.5 |
| $SnCl_2$ | Wako Junyaku K.K. | 5.3 |
| $CuCl_2$ | Wako Junyaku K.K. | 3.7 |

TABLE 4

| Treating agent | Without Heating (COMPARATIVE EXAMPLE) Hg concentration of liquid (ppb) | Removal ratio (%) | With Heating* (EXAMPLE) Hg concentration of liquid (ppb) | Removal ratio (%) |
|---|---|---|---|---|
| Activated Carbon (AC) | 113 | 24.7 | 14.0 | 90.7 |
| $ZaCl_2/AC$ | 107 | 28.7 | 9.8 | 93.5 |
| $FeCl_2/AC$ | 117 | 22.0 | 12.0 | 92.0 |
| $NiCl_2/AC$ | 101 | 32.6 | 5.1 | 96.6 |
| $SnCl_2/AC$ | 49 | 67.3 | 1.4 | 99.1 |
| $CuCl_2/AC$ | 42 | 72.0 | 0.1 or less | 99.9 or more |

*Conditions of heating: Temperature 230 degree C. Pressure 30 kgf – $cm^2$ G
In this case, the mercury concentration (as metallic mercury) in the feed stock oil was 150 ppb (wt./vol.).

Since mercury and its compounds present in hydrocarbon oil are brought into contact with a certain treating agent after they have been heated, trace amounts of mercury and its compounds present in hydrocarbon oil can be removed selectively and efficiently over an extended period of time. Since the hydrocarbon oil from which mercury and its compounds have been removed does not contain catalyst poisons, it can be used extensively in the catalytic processing such as hydrogenation.

We claim

1. A method for removing mercury and its compounds from a hydrocarbon oil comprising preheating the hydrocarbon oil to a temperature of from 150 to 300° C. under a pressure of from 0.5 to 35 kgf/cm$^2$G, and contacting the hydrocarbon oil with a treating agent at a temperature of from 20 to 250° C., wherein said treating agent is at least a member selected from the group consisting of iron, nickel, copper, zinc, aluminum, cadmium and their alloys, oxides, chlorides or sulfides supported in or on alumina, said treating agent being in granular or powdery form.

2. A method for removing mercury and its compounds from a hydrocarbon oil comprising preheating the hydrocarbon oil to a temperature of form 150 to 300° C. under a pressure of from 0.5 to 35 kgf/cm$^2$G, and contacting the hydrocarbon oil with a treating agent at a temperature of from 20 to 250° C., wherein said treating agent is at least a member selected from the group consisting of activated carbon and activated carbon having supported therein or thereon at least a member selected from iron, nickel, copper, zinc, tin, aluminum, cadmium and their alloys, oxides, chlorides or sulfides.

3. The method according to claim 2 wherein aid treating agent is active carbon having supported therein or thereon at least a member selected from iron, nickel, tin, copper, zinc and their oxides, chlorides or sulfides.

* * * * *